United States Patent [19]

Townsend

[11] Patent Number: 4,516,742

[45] Date of Patent: May 14, 1985

[54] TURRET ARRANGEMENT FOR CONTINUOUS WEB REWINDER

[75] Inventor: Ellsworth D. Townsend, Wausaukee, Wis.

[73] Assignee: Industrial Engraving and Manufacturing Corp., Pulaski, Wis.

[21] Appl. No.: 491,935

[22] Filed: May 5, 1983

[51] Int. Cl.[3] ..... B65H 19/06

[52] U.S. Cl. ..... 242/64

[58] Field of Search ..... 242/64, 56 A, 56.6, 242/67.1 R; 414/905; 74/436, 814, 820

[56] References Cited

U.S. PATENT DOCUMENTS

| | | | |
|---|---|---|---|
| 601,495 | 3/1898 | Cornell et al. | 242/56 A |
| 1,897,508 | 2/1933 | Parker | 414/905 |
| 2,512,900 | 4/1948 | Kwitek . | |
| 2,704,395 | 3/1955 | Heidegger | 74/436 X |
| 2,769,600 | 11/1956 | Kwitek et al. | 242/56.6 |
| 3,070,736 | 12/1962 | Polley | 74/436 X |
| 3,179,348 | 4/1965 | Nystrand et al. | 242/56 A |
| 3,529,785 | 9/1968 | Mistele . | |
| 3,697,010 | 10/1972 | Nystrand . | |
| 3,776,481 | 12/1973 | Ichikawa | 242/64 X |
| 3,930,620 | 1/1976 | Taitel . | |
| 4,265,409 | 5/1981 | Cox et al. | 242/56 A |
| 4,266,735 | 5/1981 | Leanna et al. . | |
| 4,280,669 | 7/1981 | Leanna et al. . | |

*Primary Examiner*—John M. Jillions

*Attorney, Agent, or Firm*—Willian Brinks Olds Hofer Gilson & Lione Ltd.

[57] ABSTRACT

A continuous web rewinding machine is provided with a geneva cam which is adjustably mounted to a hub by means of fasteners which pass through slotted openings in the cam. The hub is in turn mounted to a turret in order to transmit motion of the cam to the turret. Brackets are provided to lock the turret axis of the turret in place with respect to the rewinder in order to eliminate the swinging of the turret as in some prior art rewinders. By selecting the phase angle of the geneva cam to provide for take-up of a winding web onto a new core on a mandrel at a position no more than 4 degrees above a horizontal line extending through a bedroll, and by ensuring that the separation between each of the mandrels in the bedroll is no less than ⅜ths of an inch, efficient rewinding operations are made possible, without allowing the turret axis to swing with respect to the rewinder, and without the need for a deflector bar.

8 Claims, 8 Drawing Figures

TURRET ARRANGEMENT FOR CONTINUOUS WEB REWINDER

BACKGROUND OF THE INVENTION

This invention relates to an improved turret arrangement for automatic continuous web rewinding machines which have a rotating turret mounted on a swinging frame or apron. In such rewinding machines, web from a large roll, sometimes referred to as a "parent roll", is automatically wound onto cores to form smaller rolls having a diameter suitable for use by a consumer.

As described in detail below, the presently preferred embodiment of this invention can be used to modify Series 150 continuous web rewinding machines manufactured by Paper Converting Machine Company, of Green Bay, Wisconsin, as described in U.S. Pat. No. 2,769,600 (Kwitek), and U.S. Pat. No. 3,179,348 (Nystrand). These automatic web rewinding machines have a turret mounted for rotation within an apron which is pivotably mounted to the frame of the machine. This turret includes six rotatable mandrels which extend parallel to one another, parallel to the axis of the turret. The web being rewound passes from the parent roll to a bedroll of the machine, and is wound from the bedroll onto a core which is placed on a mandrel located at a winding station adjacent to the bedroll. A new core with glue applied to the core is mounted on an adjacent mandrel that will next approach the winding station.

In this prior art device, as the winding of the core at the winding station nears completion, the turret begins to index or rotate in order to bring the new core into position to receive the web. The apron is caused to swing toward the bedroll so that the new core is brought into close proximity to the bedroll. The web is severed by a mechanism internal of the bedroll working in concert with a cut-off roll and the free end of the web is then transferred onto the glue on the new core. On a standard 150 Series continuous winder as manufactured by Paper Converting Machine Company, this transfer will typically take place between 15 and 18 degrees above the horizontal center line of the bedroll.

Immediately after the transfer of the web onto the new core has been completed, the turret swings away from the bedroll so that the roll being wound does not contact the bedroll surface as it moves to its point of closest approach to the bedroll. This swinging motion of the apron is brought about by a swing cam that turns at a constant velocity in concert with other components within the machine. The turret finishes indexing at a dwell position. During the dwell period, the finished roll is removed by a strip mechanism, and a fresh core is positioned on one of the empty mandrels of the turret. Typically, the turret will remain in the dwell period for approximately one-third of the total winding cycle.

Thus, this prior art rewinding machine resorted to the expediency of a swinging apron for the turret in order to achieve an acceptable winding geometry. Two competing requirements of an acceptable winding geometry are (1) that each mandrel must be brought into close proximity to the bedroll in order to achieve a reliable transfer of the free end of the web onto a glued core on the mandrel, and (2) that the mandrels must be spaced sufficiently far from the bedroll to prevent the winding roll from scuffing against the bedroll. However, this prior art approach requires considerable complexity to achieve this result. In particular, means such as the swing cam must be provided to cause the apron to swing with respect to the frame. Typically, a boost cylinder is used in order to facilitate the swinging action. Typically used boost cylinders can result in excessive wear on gear trains used to transmit power to the turret.

Furthermore, the vibration and backlash of the turret and turret drive assembly brought about by the swinging turret design can adversely affect performance of the rewinding machine. These problems are particularly acute when the rewinding machine is run at high cycle rates, in which case the rate of oscillation of the swinging turret must be increased.

There have been a number of attempts in the past to overcome the aforementioned disadvantages of the Series 150 automatic web rewinding machines. For example, the manufacturer of these machines has proposed modifications to the machines in which the mandrel turret is able to rotate but not to swing. A cam box is used to accomplish rotation and dwell of the turret, and the web is transferred to a new core substantially on the horizontal center line of the bedroll of these modified machines. However, due to the tangent line of the web over the bedroll to the outer perimeter of the finished roll and the possibility for interference between this web and the newly-glued core on the incoming mandrel, a moving deflector bar was found necessary to deflect the web at and during the critical point of transfer to prevent undesired contact between the web and the glued core on the incoming mandrel. Such a deflector bar, of course, increases the cost, complexity, and possibility for unreliability in a rewinding machine.

Other proposed modifications to the Series 150 continuous winders contemplated locking the swinging apron in place, and effecting transfer of the web onto a fresh core at four degrees above the center line of the bedroll. In this proposed modification, a standard, 5/16 inch clearance was provided at all times between the periphery of the bedroll and the outer periphery of the mandrels. This proposed modification suffered from the disadvantage that a deflector bar was required in the event a roll with a finished diameter of less than four inches was to be wound.

SUMMARY OF THE INVENTION

The present invention is directed to an improved turret arrangement for automatic web rewinding machines which provides important advantages over the systems described above. In particular, this invention relates to a modification to an automatic continuous web rewinding machine of the type comprising a frame, an apron pivotably mounted to the frame, a mandrel spider pivotally mounted to the apron, a plurality of mandrels mounted to the spider, means for indexing a geneva cam, and a bedroll mounted adjacent the mandrels to pass a web to a core mounted on one of the mandrels when said one of the mandrels is in a take-up position.

According to this invention, a rewinding machine of the type described above is provided with means for locking the apron in place with respect to the frame to prevent pivotal movement therebetween. A geneva cam is provided which defines an array of elongated mounting slots. This cam is mounted securely to a hub by fasteners which extend through the elongated mounting slots such that the angular position of the geneva cam with respect to the hub can be adjusted as desired. The hub is in turn rigidly secured to the spider by a plurality of fasteners. In this invention, the geneva cam is positioned to be indexed by the indexing means such that a mandrel, when in the take-up position, is within the range of three degrees above to four degrees below a horizontal line passing through the center of the bedroll. Preferably, the mandrel spider is positioned with respect to the bedroll such that the minimum separation between the mandrels and the bedroll is no less than about $\frac{3}{8}$ of an inch as the spider rotates, and the web passes directly from the bedroll to a winding roll on the core without deflection, throughout the winding of a roll having a finished diameter less than four inches. Further aspects of this invention relate to a particularly effective design for the means for locking the apron in place on the frame, and to a timing plate arrangement which can be used to facilitate alignment of the geneva cam with respect to the frame.

The present invention provides important advantages over prior art approaches. In particular, it allows the axis of rotation of the turret to be fixed in place with respect to the frame in order to eliminate the disadvantages that accompany a swinging turret design as described above. Furthermore, because the present invention provides an improved winding geometry, reliable transfer of the web onto an incoming core is assured, and finished rolls having a diameter of less than four inches can be wound without requiring a deflector bar to deflect the winding web away from an incoming glued core. The present invention can be used to modify a prior art automatic continuous web rewinding machine as described above in a particularly simple, inexpensive and straight-forward manner. The present invention can be used to enhance the performance of such prior art rewinding machines significantly and at modest expense.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
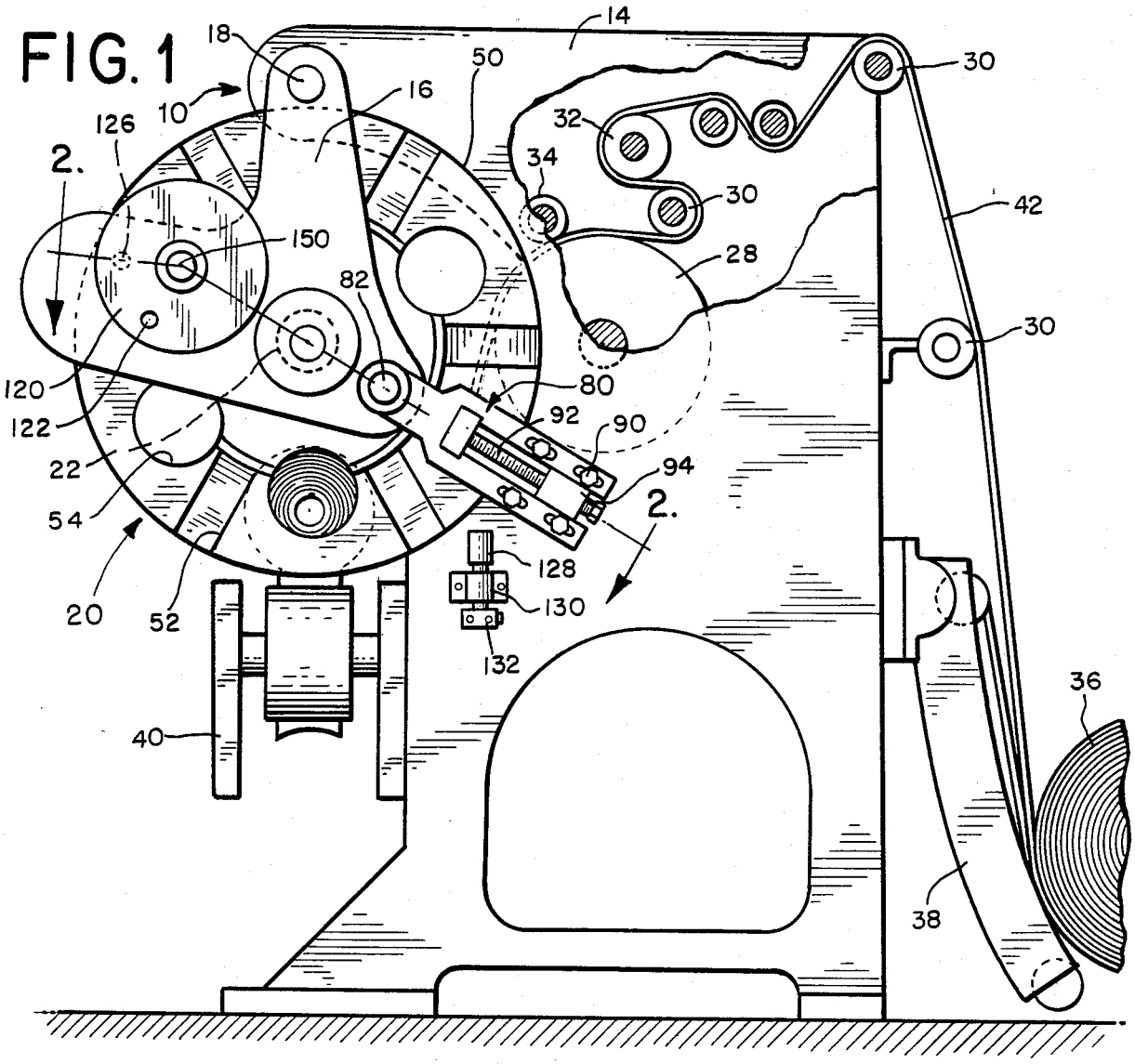
FIG. 1 is a schematic view of an automatic web rewinding machine which incorporates a presently preferred embodiment of this invention.

Turning now to the drawings, FIG. 1 shows a schematic representation of a portion of an automatic continuous web rewinding machine. In many respects, this machine is similar to the web winding machine disclosed in U.S. Pat. No. 2,769,600 (Kwitek et al), which is hereby incorporated by reference for a general teaching of the functioning of this web winding machine.

As shown in FIG. 1, the rewinder 10 includes a frame 14 on which an apron 16 is mounted to pivot about an apron axis 18. In actuality, there are two parallel aprons 16,104, one at either end of the rewinder 10 mounted to swing about the same apron axis 18. A turret 20 is mounted between the aprons 16,104 to rotate about a turret axis 22. This turret 20 defines in this preferred embodiment six turret mandrels 24*a*–24*f*, each of which is mounted to a mandrel spider 25. As will be described below in greater detail, each of the turret mandrels 24*a*–24*f* is sized and positioned to receive a core, such as a cardboard core for rolled bathroom tissue. One end of each of the mandrels 24*a*–24*f* is free in order to allow cores to be installed on and removed from the respective mandrels. An indexing mechanism 26 is provided, which in this embodiment is a geneva crank arm rotatably mounted to the apron 16 by means of a shaft 150 so as to index a geneva cam mounted on the turret 20. The structure and operation of this geneva cam 50 has a number of novel features according to the present invention, and will be described in detail below.

The rewinder 10 also includes a bedroll 28 mounted to rotate about a horizontal axis. Similarly, a perforating roll 32 is provided to perforate the web 42 being rewound, and a chopping roll 34 is provided to cut the web 42 when desired. A plurality of idler rolls 30 act to position and tension the web 42 as desired. The web 42 originates from a parent roll 36, and is removed from the parent roll 36 by a parent roll drive 38.

In use, the rewinder 10 operates to pass the web 42 from the parent roll 36 past the various idler rolls 30, the perforating roll 32, onto the bedroll 28. From the bedroll 28, the web 42 is passed to successive cores mounted on the turret mandrels 24*a*–24*f*.

In the embodiment of FIG. 1, the turret 20 rotates in a clockwise direction. Thus, a winding roll 44 of the web 42 moves downward and to the left as shown in FIG. 1, away from the bedroll 28. When a roll has been completed, the chopping roll 34 severs the web 42, and a mechanism included in the bedroll 28 serves to transfer the free end of the web 42 onto an incoming core to which glue has previously been applied. This incoming core is rotating and once transfer of the web 42 has been completed, the rotating incoming core begins to build up a roll of the web 42. The turret 20 continues to rotate moving the building roll 44 down and away from the bedroll 28 to dwell and wind. Simultaneously, the finished roll 46 is positioned over the discharge conveyor 40. This discharge conveyor 40 operates to slide the finished core and roll off of the mandrel. In order to complete the cycle, a new core is loaded onto the next mandrel simultaneously.

The foregoing description of the rewinder 10 relates to conventional aspects of the rewinder 10 which are part of the prior art and form no part of the present invention. Each of these features can be understood in detail by referencing appropriate portions of the Kwitek patent identified above. For this reason, these standard features of the rewinder 10 will not be described in greater detail here.

The present invention is directed to a novel turret arrangement which provides a particularly effective winding geometry.

Figures 2, 4:
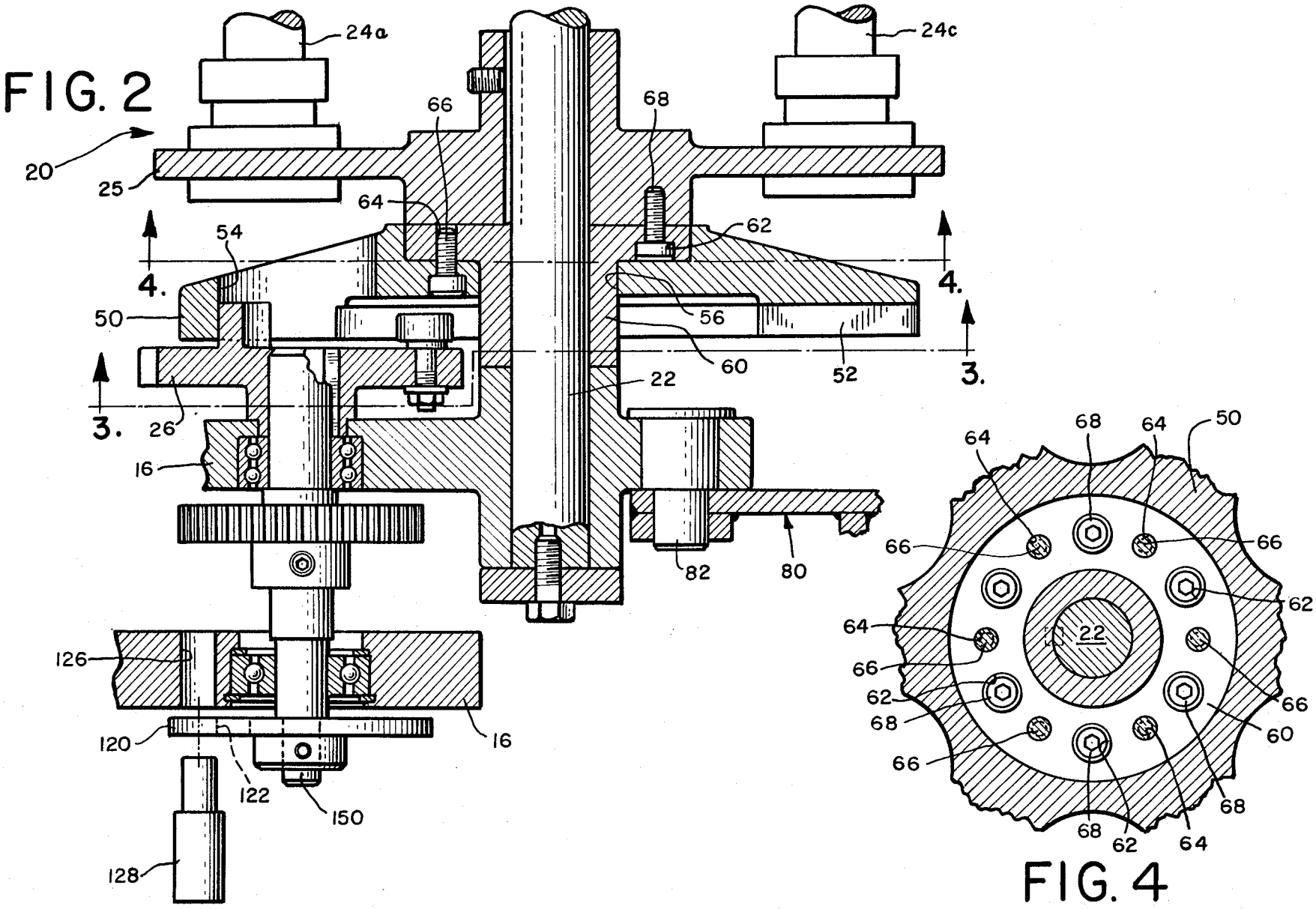
FIG. 2 is a sectional view taken along line 2—2 of FIG. 1.
FIG. 4 is a sectional view taken along line 4—4 of FIG. 2.
Figure 3:
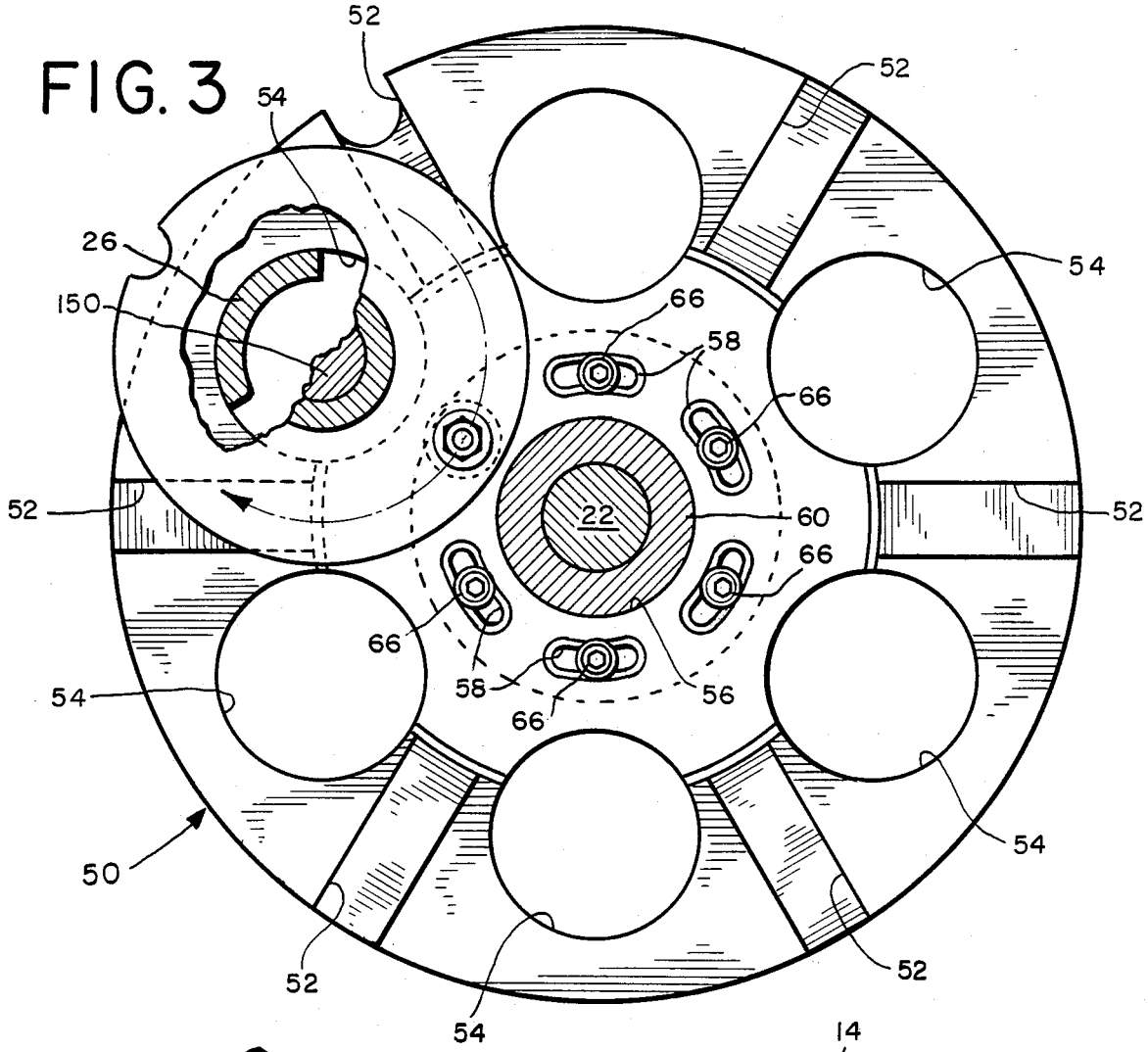
FIG. 3 is a view of the face of the geneva cam taken along line 3—3 of FIG. 2.

According to this invention, the geneva cam 50 is provided with conventional slots 52 and recesses 54 which cooperate with the geneva crank arm 26 to index the geneva cam 50 in the conventional manner. In addition, however, the geneva cam 50 defines a central opening 56 and an array of elongated mounting slots 58 arrayed around the central opening 56, as best shown in FIG. 3. This central opening 56 is sized to receive the upstanding portion of a hub 60. As best shown in FIG. 4, this hub defines a circular array of countersunk holes 62 as well as a circular array of threaded holes 64. A first plurality of fasteners 66 extend through the mounting slots 58 in the geneva cam 50 into the threaded holes 64 in order to secure the geneva cam 50 to the hub 60. A second array of fasteners 68 are positioned in the countersunk holes 62 in order to secure the hub 60 to the turret spider 25. Thus, the geneva cam 50 is secured to the hub 60, which is in turn secured to the turret spider 25. The elongated mounting slots 58 allow great flexibility in the phase angle between the geneva cam 50 and the hub 60. By loosening the fasteners 66 and rotating the geneva cam 50 with respect to the hub 60, any of a wide range of phase angles for the geneva cam 50 with respect to the spider 25 can be selected and maintained. In this preferred embodiment, the geneva cam 50 is oriented with respect to the hub 60 so as to position each of the turret mandrels 24*a*–24*f* at the moment the free end of the web is secured to a new core on about the horizontal line extending through the center of the bedroll 28.

Figure 5:
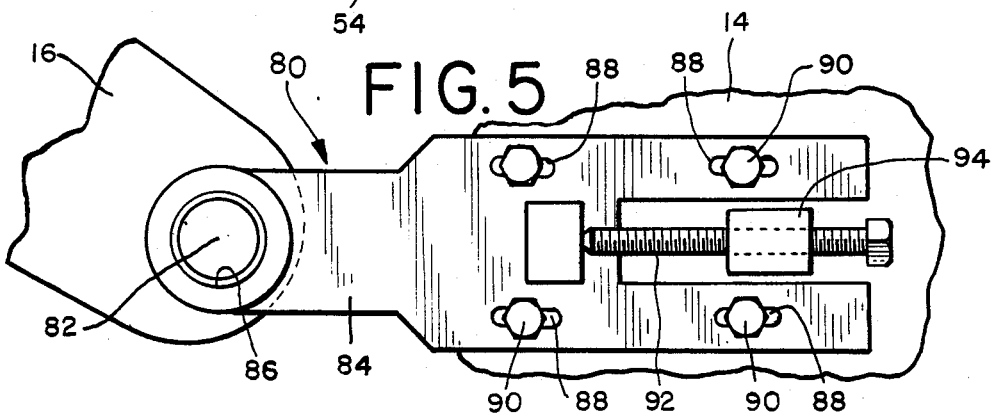
FIG. 5 is an enlarged fragmentary view of a bracket used to lock the front apron in place with respect to the frame.

The rewinder 10 also includes two bracket assemblies 80,100 which are provided to lock the turret axis 22 in place with respect to the frame 14. As shown in FIG. 5, the first bracket assembly 80 comprises a pin 82 received in a pre-existing aperture in the apron 16. This bracket assembly 80 also includes a locking plate 84 which defines an aperture 86 sized to receive the pin 82. The plate 84 defines a plurality of elongated slots 88, and a respective fastener 90 is positioned in each of the slots 88 and secured to the frame 14. In addition, a lug 94 is fastened securely to the frame 14, as for example by fasteners. Furthermore, a jack screw 92 is mounted in the plate 84 to bear on the lug 94. By rotating the jack screw 92 in the plate 84, the apron 16 can be pivoted about the apron axis 18 to a desired position. Once the apron 16 is in the desired position, the first bracket assembly 80 can be securely locked in place by tightening the fasteners 90. In this preferred embodiment, the first bracket assembly 80 is preferably locked in place to maintain the minimum separation between each of the turret mandrels 24*a*–24*f* and the bedroll 28 at a separation no less than $\frac{3}{8}$ of an inch.

Figure 6:
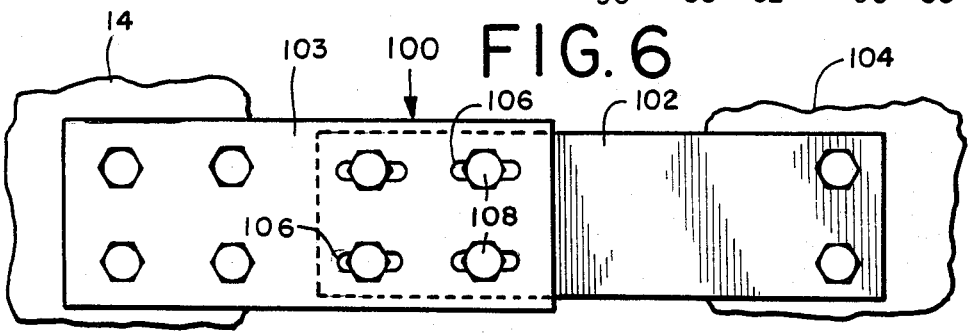
FIG. 6 is an enlarged fragmentary view of a bracket used to lock the rear apron in place with respect to the frame.

As defined in the Kwitek patent referenced above, the second apron 104 is situated at the rear of the winder 10, and it serves to support the turret 20 at its rear end. In this preferred embodiment, a second bracket assembly 100 is provided to secure this second apron 104 in place with respect to the frame 14, as shown in FIG. 6. This second bracket assembly 100 includes a frame plate 102 which is securely fastened in place on the frame 14 and an apron plate 103 which is securely fastened to the second apron 104. The apron plate 103 defines a plurality of elongated slots 106, and fasteners 108 are provided which extend through the slots 106 to clamp together the frame plate 102 and the apron plate 103. This second bracket assembly 100 operates to lock the second apron 104 in place with respect to the frame 14.

An additional feature of the rewinder 10 is a timing plate 120 as shown in FIG. 2. This timing plate 120 is mounted on the shaft 150 of the geneva crank arm 26, as for example, by set screws. The timing plate 120 defines a timing hole 122 spaced some distance from the center of the timing plate 120. As shown in FIG. 2, this timing plate 120 is positioned to rotate with the shaft 150 adjacent to a portion of the apron 16. This apron 16 defines an apron hole 126 which is positioned to align with the timing hole 122 when the geneva crank shaft 150 is aligned properly. When properly aligned, a timing pin 128 can be passed through the apron hole 126 into the timing hole 122. In this way, the rewinder 10 can readily be aligned when it is necessary to certify the correct point of transfer when retiming the machine.

In order to prevent inadvertent startup of the rewinder 10 with the timing pin 128 in place in the timing hole 122, the rewinder 10 includes a pin bracket 130 mounted to the frame 14, as shown in FIG. 1. A switch 132 is positioned directly under the pin bracket 130 and is coupled with the electronic control system of the rewinder 10 such that the rewinder 10 is disabled from operation unless the switch 132 is depressed and closed. The switch 132 is arranged such that it is depressed by the timing pin 128 when the timing pin 128 is placed within the pin bracket 130.

The pin bracket 130 and the switch 132 cooperate to prevent the rewinder 10 from being started until the timing pin 128 is safely in place in the pin bracket 130. In this way, major rewinder damage caused by an attempt to start the rewinder 10 with the timing pin 128 in place in the timing hole 122 is avoided.

Figure 1A:
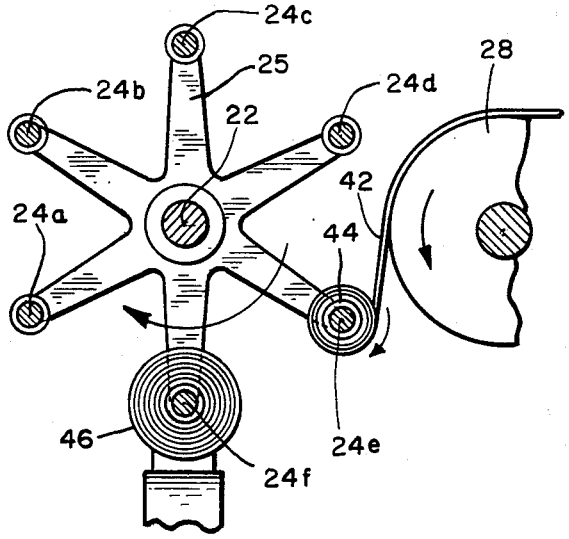
FIGS. 1*a* and 1*b* are schematic views showing the relative orientation of the mandrels in the dwell position and in the take-up position, respectively.
Figure 1B:
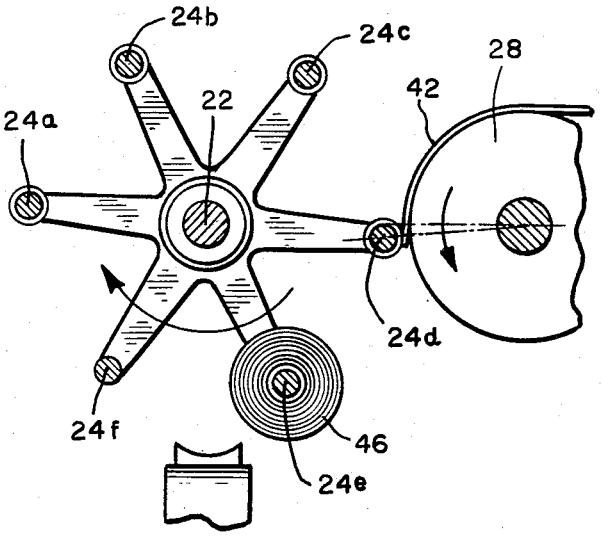

In order to set up the rewinder 10 it is necessary to utilize the adjustable geneva cam 50 to locate the dwell of the geneva cam where desired, and to utilize the first and second bracket assemblies 80,100 to obtain the desired separation between the mandrels 24*a*–24*f* and bedroll 28. The presently preferred transfer angle of the geneva cam 50 locates each of the mandrels 24*a*–24*f* for take-up of the free end of the web 42 at a position such that the center line of the respective one of the mandrels 24*a*–24*f* is located in the range of 4 degrees below to 3 degrees above the horizontal line extending through the center of the bedroll 28. As used herein, such angles are measured with respect to the center of the bedroll 28, as shown in FIG. 1*b*, which shows mandrel 24*d* in the take-up position. In many cases, it is preferred to maintain this take-up point at an orientation which defines a zero angle with respect to the horizontal line extending through the center of the bedroll 28. By providing a take-up angle of no more than 3 degrees above the horizontal, a favorable winding geometry is obtained. In particular, the tangent line of the web over the bedroll as it addresses the outer periphery of the finished, wound roll is improved.

Furthermore, it is preferred to keep the minimum separation between the peripheries of each of the mandrels 24*a*–24*f* and the bedroll 28 no less than $\frac{3}{8}$ of an inch. This is a larger distance between the mandrels and bedroll than is customarily used, but it provides the important advantage of eliminating the need for a deflector bar to prevent the web 42 from coming into contact prematurely with the incoming glued core. By positioning the transfer point to occur at below the horizontal line extending through the bedroll 28, smaller diameter rolls can be wound without causing the web 42 to contact the glued incoming mandrel. Of course, the absence of such a deflector bar provides important advantages in terms of increased simplicity of design. It also provides the machine operator with a better view of the winding roll and eliminates a potential safety hazard. The preferred geometry above allows the building paper roll to grow without scuffing the bedroll 28. Once the rewinder 10 has been aligned properly, the frame hole 126 or the timing hole 122 can be drilled to facilitate realignment.

As explained above, the geneva cam 50 provides alternate periods of indexing and of dwell. A number of events occur during the dwell segment of the cycle. When in the dwell orientation of FIG. 1*a*, the new roll builds on the mandrel 24*e* which is in position to receive the web 42. The previously finished roll 46 on the mandrel 9*f* is removed from the mandrel 9*f* by the discharge conveyor 40. Furthermore, a new core is installed on the mandrel 24*a*, and the adjacent core on the mandrel at the position 24*b* can be cut if the machine is so equipped. At the station corresponding to mandrel 24*d* in FIG. 1*a*, a cored mandrel is accelerating to reach a speed appropriate to receive the web 42. By adjustably positioning the geneva cam 50 with respect to the turret spider 25, the location of the dwell can be adjusted as desired. In this way, the dwell position can be maintained as appropriate in alignment with the discharge conveyor 40 and the other stations of the rewinder 10. If necessary, elliptical gears can be used to drive the geneva crankshaft 150 in order to increase the proportion of time spent in the dwell mode.

Once the phase angle of the geneva cam 50 has been selected and locked in place and the aprons 16,104 have been adjusted and locked in place, it may be necessary to adjust other portions of the rewinder 10 in order to ensure proper operation. In particular, parts of the web transfer system in the bedroll should be advanced in order to accommodate the lower transfer point used for the web 42. This can readily be done by modifying the web transfer system shown in FIG. 10 of the above-identified Kwitek patent as, for example, by elongating the slots which receive the fasteners 298. Such elongated slots allow the timing of the bedroll transfer system to be advanced to cause the leading edge of the severed web 42 to be pushed off of the bedroll 28 at the appropriate position.

In addition, rewinders such as the one disclosed in the Kwitek patent include mechanisms in the mandrels 24*a*–24*f* for locking a core to the mandrels 24*a*–24*f* during certain angular positions of the turret 20. Typically, this locking arrangement is activated by a cam plate mounted on the frame 14, and it may be necessary to lengthen or extend the cam plate in order to maintain the core's engagement with the mandrel through a longer arc. Similarly, the mechanically metered winding system will have to be retimed to accommodate the changed angular position of the mandrels 24 as they are winding. Of course, the mechanism utilized to swing the apron 16 back and forth with respect to the frame 20 should be removed, along with any boost cylinders used to augment the swinging action of the apron 16.

It has been found that the winding geometry described above provides important advantages in that it eliminates the need for a swinging turret, it allows the winding of even small diameter rolls without a deflector bar, and it can readily be retrofitted to standard rewinders such as Series 150 rewinders manufactured by Paper Converting Machine Company. Such modifications can be accomplished quickly and at relatively low cost, and they can provide significant improvements in the speed and efficiency of rewinder operation.

Of course, it should be understood that a wide variety of changes and modifications to the preferred embodiments described above will be apparent to those skilled in the art. It is therefore intended that the foregoing detailed description be regarded as illustrative rather than limiting, and that it be understood that it is the following claims, including all equivalents, which are intended to define the scope of this invention.

I claim:

1. In an automatic continuous web rewinding machine of the type comprising a frame, an apron pivotably mounted to the frame, a mandrel spider pivotably mounted to the apron, a plurality of mandrels mounted to the spider, means for indexing a geneva cam, and a bedroll mounted adjacent the mandrels to pass a web to a core mounted on one of the mandrels when said one of the mandrels is in a take-up position, the improvement comprising:

means for locking the apron in place with respect to the frame to prevent pivotal movement therebetween;

a geneva cam which defines an array of elongated mounting slots;

a hub secured rigidly to the spider by a first plurality of fasteners;

fastener means for securing the geneva cam to the hub such that the angular position of the geneva cam with respect to the hub is adjustable, said fastener means comprising a second plurality of fasteners, each of which extends through a respective one of the mounting slots;

said geneva cam positioned to be indexed by the indexing means such that the take-up position is within the range of three degrees above to four degrees below a horizontal line passing through the center of the bedroll;

a timing plate secured to the indexing means to move with the indexing means, said timing plate defining a timing hole;

means for defining a timing opening in the apron adjacent the timing plate, said timing hole and opening situated such that they are in alignment when the geneva cam is in alignment with respect to the apron;

a timing pin sized to fit through the timing hole into the timing opening to hold the geneva cam in alignment during cam adjustment;

a bracket mounted to the frame to hold the timing pin; and a switch mounted to the frame in alignment with the bracket such that the switch is actuated by the pin when the pin is in the bracket, said switch operative to allow operation of the machine only when the switch is actuated.

2. The invention of claim 1 wherein the locking means comprises:

a locking plate which defines a plurality of slotted openings;

a lug mounted to the frame;

a jack screw mounted to the locking plate to adjust the separation between the locking plate and the machine;

means for coupling the locking plate to the apron; and means for clamping the locking plate to the frame, said clamping means comprising a plurality of clamping fasteners extending through the slotted openings.

3. The invention of claim 1 wherein the geneva cam is positioned with respect to the hub such that the take-up position is oriented no higher than the horizontal line passing through the center of the bedroll.

4. The invention of claim 1 wherein said mandrel spider is positioned with respect to the bedroll such that the minimum separation between the mandrels and the bedroll is no less than about $\frac{3}{8}$ inch as the spider rotates, and the web passes directly from the bedroll to a winding roll on the core, without deflection, throughout the winding of a roll having a finished diameter less than four inches.

5. In an automatic continuous web rewinding machine of the type comprising a frame, an apron pivotably mounted to the frame, a mandrel spider pivotably mounted to the apron, a plurality of mandrels mounted to the spider, means for indexing a geneva cam, and a bedroll mounted adjacent the mandrels to pass a web to a core mounted on one of the mandrels when said one of the mandrels is in a take-up position, the improvement comprising:

a locking plate secured in place both to the apron and the frame to prevent pivotal movement therebetween, said plate effective to maintain the minimum separation between the bedroll and the mandrels at no less than $\frac{3}{8}$ inch;

a geneva cam;

means for adjustably mounting the cam to the spider such that the geneva cam is indexed by the indexing means and the take-up position is oriented no higher than three degrees above a horizontal line extending through the center of the bedroll;

a timing plate secured to the indexing means to move with the indexing means, said timing plate defining a timing hole;

means for defining a timing opening in the apron adjacent the timing plate, said timing hole and opening situated such that they are in alignment when the geneva cam is in alignment with respect to the apron;

a timing pin sized to fit through the timing hole into the timing opening to hold the geneva cam in alignment during cam adjustment;

a bracket mounted to the frame to hold the timing pin; and a switch mounted to the frame in alignment with the bracket such that the switch is actuated by the pin when the pin is in the bracket, said switch operative to allow operation of the machine only when the switch is actuated.

6. The invention of claim 5 wherein the take-up position is oriented on the horizontal line extending through the center of the bedroll.

7. The invention of claim 6 wherein the apron and cam are situated such that the web passes directly from the bedroll to a winding roll on the core, without deflection, throughout the winding of a roll having a finished diameter less than four inches.

8. In an automatic continuous web rewinding machine of the type comprising a frame, an apron pivotably mounted to the frame, a mandrel spider pivotably mounted to the apron, a plurality of mandrels mounted to the spider, means for indexing a geneva cam, and a bedroll mounted adjacent the mandrels to pass a web to a core mounted on one of the mandrels when said one of the mandrels is in a take-up position, the improvement comprising:

means for locking the apron in place with respect to the frame to prevent pivotal movement therebetween;

a geneva cam which defines an array of elongated mounting slots;

a hub secured rigidly to the spider by a first plurality of fasteners;

fastener means for securing the geneva cam to the hub such that the angular position of the geneva cam with respect to the hub is adjustable, said fastener means comprising a second plurality of fasteners, each of which extends through a respective one of the mounting slots;

said geneva cam positioned with respect to the hub to be indexed by the indexing means such that the take-up position is within the range of three degrees above to four degrees below a horizontal line passing through the center of the bedroll;

said mandrel spider positioned with respect to the bedroll such that the minimum separation between the mandrels and the bedrolls is no less than $\frac{3}{8}$ inch and the web passes directly from the bedroll to a winding roll on the core, without deflection, throughout the winding of a roll having a finished diameter less than four inches;

a timing plate secured to the indexing means to move with the indexing means, said timing plate defining defining a timing hole;

means for defining a timing opening in the apron adjacent the timing plate, said timing hole and opening situated such that they are in alignment when the geneva cam is in alignment with respect to the apron;

a timing pin sized to fit through the timing hole into the timing opening to hold the geneva cam in alignment during cam adjustment;

a bracket mounted to the frame to hold the timing pin; and a switch mounted to the frame in alignment with the bracket such that the switch is actuated by the pin when the pin is in the bracket, said switch operative to allow operation of the machine only when the switch is actuated.

* * * * *